United States Patent [19]

Kanada et al.

[11] 4,410,036

[45] Oct. 18, 1983

[54] HEAT EXCHANGER MADE OF ALUMINUM ALLOYS AND TUBE MATERIAL FOR THE HEAT EXCHANGER

[75] Inventors: Kenso Kanada, Anjo; Yoshiharu Hasegawa, Oobu; Hiroshi Kawase, Imaichi; Kazunori Ishikawa, Nikko, all of Japan

[73] Assignees: Nippondenso Co., Ltd., Kariya; Furukawa Aluminum Co., Ltd., Tokyo, both of Japan

[21] Appl. No.: 305,357

[22] Filed: Sep. 24, 1981

[30] Foreign Application Priority Data

Oct. 1, 1980 [JP] Japan ..... 55-137043
Oct. 21, 1980 [JP] Japan ..... 55-146352

[51] Int. Cl.[3] ..... F28F 19/06
[52] U.S. Cl. ..... 165/134 R; 165/180
[58] Field of Search ..... 165/133, 134 R, 134 DP, 165/180, DIG. 8; 75/138–145

[56] References Cited

U.S. PATENT DOCUMENTS

| | | | |
|---|---|---|---|
| 1,662,383 | 3/1928 | Grimditch et al. | 75/139 |
| 3,809,155 | 5/1974 | Anthony et al. | 165/133 |
| 3,928,027 | 12/1975 | Harkness | 75/139 |
| 3,960,208 | 6/1976 | Anthony et al. | 165/180 X |
| 4,192,693 | 3/1980 | Chia et al. | 75/139 X |
| 4,203,490 | 5/1980 | Terai et al. | 165/134 R |
| 4,209,059 | 6/1980 | Anthony et al. | 165/180 X |
| 4,224,065 | 9/1980 | Jaquet et al. | 75/139 |

FOREIGN PATENT DOCUMENTS

| | | | |
|---|---|---|---|
| 2911295 | 10/1979 | Fed. Rep. of Germany | 165/180 |
| 47-36341 | 9/1972 | Japan | 165/133 |
| 55-95094 | 7/1980 | Japan | 165/134 R |
| 860469 | 2/1961 | United Kingdom | 165/134 |

*Primary Examiner*—Sheldon J. Richter
*Attorney, Agent, or Firm*—Cushman, Darby & Cushman

[57] ABSTRACT

A heat exchanger made of aluminum alloys comprising a tube made of an aluminum alloy consisting of 0.2 to 1.0 wt % of Cu and the balance Al and inevitable impurities, and fins jointed to the tube, at least a portion of each fin being formed from another aluminum alloy exhibiting and electrochemical potential value lower than that of the aluminum alloy from which the tube is made, so as to provide a sacrificial corrosion effect. Disclosed also is an aluminum alloy material having superior hot-extrusion characteristics and pitting corrosion resistance suitable for use as the material of heat exchanger tubes, the aluminum alloy material consisting of 0.2 to 1.0 wt % of Cu and the balance Al and inevitable impurities.

4 Claims, 5 Drawing Figures

HEAT EXCHANGER MADE OF ALUMINUM ALLOYS AND TUBE MATERIAL FOR THE HEAT EXCHANGER

BACKGROUND OF THE INVENTION

The present invention relates to a heat exchanger made of aluminum alloys, such as condenser, evaporator and so forth incorporated in automobile air conditioners, and more particularly relates to a corrugate fin type heat exchanger made of aluminum alloys and improved to prevent pitting corrosion of the heat exchanger tubes, and further relates to a tube material for such heat exchanger.

Conventionally, the tubes of corrugate fin type heat exchangers made of aluminum alloys are formed of an aluminum alloy generally referred to as 3003 specified in the U.S. Aluminum Association Standard (hereinafter called "AA") having compositions consisting essentially of 0.05 to 0.20 wt% of Cu, not more than 0.6 wt% of Si, not more than 0.7 wt% of Fe, 1.0 to 1.5 wt% of Mn, not more than 0.10 wt% of Zn and the balance Al, or are formed of an aluminum alloy of compositions having a slightly lower Mn content than the AA 3003 aluminum alloy. As to the material of the corrugate fin, a core material of an aluminum-zinc alloy, which has an electrochemical potential lower than the AA 3003 aluminum alloy constituting the tubes and thus exhibits a sacrificial corrosion effect to prevent the corrosion of the tubes, is used in combination with a cladding layer for brazing filler alloy.

The AA 3003 aluminum alloy used as the tube material, however, has such poor drawing or hot-extrusion characteristics (drawability or hot-extrudability) as amounts, for example, to about $\frac{1}{3}$ of that of pure aluminum such as AA 1050. Therefore, the production of the heat exchanger tubes from the AA 3003 alloy by drawing or hot-extrusion costs much higher than the production from the pure aluminum, resulting in a raised cost of production of the heat exchanger as a whole.

SUMMARY OF THE INVENTION

Accordingly, an object of the invention is to provide a heat exchanger made of aluminum alloys, capable of eliminating the above-described problems of the prior art while maintaining the pitting corrosion resistance of the tubes equivalent to that of the tubes made from the AA 3003 aluminum alloy.

To this end, according to the invention, there is provided a heat exchanger made of aluminum alloys comprising tubes each made of an aluminum alloy consisting essentially of 0.2 to 1.0 wt% of Cu, the balance aluminum and inevitable impurities; and fins attached to the tubes, at least a part of each fin being made of another aluminum alloy which is lower in electrochemical potential than the aluminum alloy constituting the tubes thereby to bring about a sacrificial corrosion effect.

In the heat exchanger in accordance with the invention, the aluminum alloy used as the material of the tube is an alloy consisting essentially of 0.2 to 1.0 wt% of Cu, the balance aluminum and inevitable impurities in which, particularly, the amount of Fe and Si is not more than 1.0 wt%.

Hereinafter, the percentages (%) of contents of aluminum alloy compositions will be represented as weight percent (wt%).

According to the invention, an aluminum alloy consisting of 0.2 to 1.0% of Cu and the balance aluminum and inevitable impurities is used as the alloy material for the tubes of the heat exchanger. This alloy has a greater copper content than the pure aluminum (AA 1050) conventionally used as a tube material which pure aluminum consisting of not more than 0.05% of Cu, not more than 0.25% of Si, not more than 0.40% of Fe, not more than 0.05% of Mn, not more than 0.05% of Mg, not more than 0.05% of Zn, not more than 0.03% of Ti and more than 99.50% of Al. Thus, this alloy used in the present invention exhibits an electrochemical potential value approximating that of the conventional tube material, i.e. AA 3003 aluminum alloy. If the copper content in the alloy is below 0.2%, unsatisfactorily the electrochemical potential of the alloy does not become similar to that of the AA 3003 aluminum alloy. To the contrary, a copper content in excess if 1.0% makes the alloy impractically hard in hardness to decrease the characteristics of the drawing or hot-extrusion, as well as bending characteristics of the alloy, although the electrochemical potential becomes sufficiently high in value. It is a particular tendency peculiar to copper that the electrochemical potential of the aluminum alloy is increased by addition of a small amount of copper. It is also possible to obtain a drawing or hot-extrusion characteristics, as well as bending characteristics, equivalent to that of AA 1050 aluminum alloy, by maintaining the amount of addition of copper at a level not more than 1.0%. By using this tube material in combination with the fin material acting as a sacrificial anode, it is possible to obtain a pitting corrosion resistance of the tubes equivalent to that of the conventionally used AA 3003 aluminum alloy. The sacrificial anode material is constituted by a brazing sheet in which a brazing filler material of Al-Si base alloy or Al-Si-Mg base alloy acting as a cladding layer is clad to each surface of the core with a cladding ratio of 5 to 20% with respect to each side of the core material. The core material may be formed from an Al-Mn base alloy such as AA 3003, AA 3203 or the like with an addition of small amount of Zn, Sn or In. These elements may be added also to the brazing filler material. The bonding of the fins to the tube is achieved by a brazing method including flux brazing, vacuum brazing, brazing process under an inert gas atmosphere and so forth.

According to the invention, an alloy obtained by adding small amounts of Sn and Zn to the AA 3003 aluminum alloy is preferably used as the material of the core member of the sacrificial corrosion fin having lower electrochemical potential value for use in combination with the above-described tubes of heat exchanger made from aluminum alloy embodying the present invention. For instance, the core member of the fin is made of an aluminum alloy consisting of 0.05 to 0.20% of Cu, not more than 0.6% of Si, not more than 0.7% of Fe, 1.0 to 1.5% of Mn, not more than 1.0% of Zn, not more than 0.06% of Sn, and the balance aluminum and not more than 0.15% of inevitable impurities. It is also possible to use as the material of the core member of the sacrificial corrosion fin an alloy which is obtained by adding not more than 1.0% of Zn and not more than 0.06% of Sn to the AA 3203 alloy which consists of not more than 0.05% of Cu, not more than 0.6% of Si, not more than 0.7% of Fe,, 1.0 to 1.5% of Mn, not more than 0.10% of Zn and the balance Al.

According to the invention, it is also preferred to use, as an aluminum alloy material for tubes having a pitting corrosion resistance equivalent to that of the AA 3003 aluminum alloy when combined with the sacrificial anode fin and extrusion characteristic equivalent to that of pure aluminum such as AA1050, AA1100 and the like, an alloy consisting essentially of 0.2 to 1.0% of Cu, and the balance Al and inevitable impurifies in which, particularly, the amount of Fe and Si is not more than 1.0%. Fe and Si exist unavoidably or inevitably as impurities of aluminum. Moderate cost and strength are obtainable by the presence of Fe and Si. However, if the sum of the Fe and Si contents exceeds 1.0%, the corrosion resistance of the aluminum alloy is decreased and the extrudability into tubes and the formability of tubes after extrusion is decreased undesirably. In order to reduce the Fe and Si contents, it is necessary to use aluminum metal having a high purity. Such a aluminum metal having high purity, however, is generally expensive. For reducing the cost to an acceptable level while maintaining the required mechanical strength and other requisites, the sum of Fe and Si contents is preferably in a range between 0.4 and 1.0%.

Other objects, features and advantages of the invention will become clear from the following description of the preferred embodiments taken in conjunction with the accompanying drawings.

DESCRIPTION OF THE PREFERRED EMBODIMENTS

Figure 1:
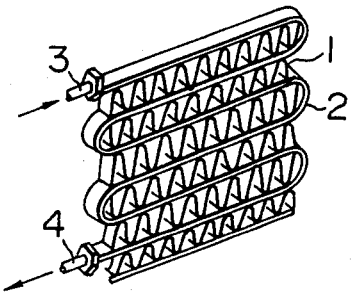
FIG. 1 is a perspective view of a condenser which embodies the heat exchanger in accordance with the invention.
Figure 2:
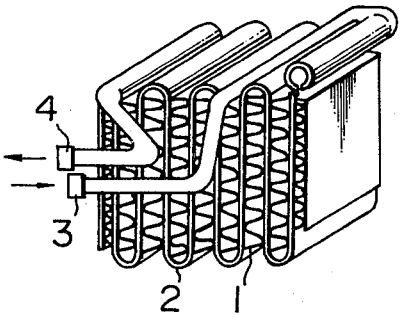
FIG. 2 is a perspective view of an evaporator which embodies the heat exchanger in accordance with the invention.
Figure 3:
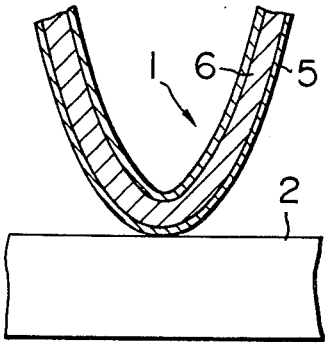
FIG. 3 is an enlarged view of a part of the heat exchanger in accordance with the invention showing particularly the state of jointing between the fins and tubes.

FIGS. 1 and 2 illustrate, respectively, a condenser and an evaporator constructed in accordance with the heat exchangers of first to fifth embodiments described hereinunder. Each heat exchanger comprises a plurality of corrugate fins 1 arranged between adjacent turns of a winding tube 2 formed by a hot-extrusion. Reference numerals 3 and 4 designate, respectively, a fluid inlet and a fluid outlet. FIG. 3 shows, in larger scale, the tube 2 and the corrugate fin 1 of the heat exchanger. It will be seen that the corrugate fin 1 is constituted by a core member 6 and a cladding 5 which is made of a brazing filler. As shown in the drawings, the corrugate fin 1 is bonded by brazing to adjacent turns of the tube 2 which is bent to have a meandering form. This brazing is made by making use of the brazing material cladding 5 which is beforehand provided on the surface of the core member 6. Pipes for the fluid inlet 3 and fluid outlet 4 are connected to both ends of the tube 2. In the drawings, the arrow indicates the direction of flow of a refrigerant.

Embodiment 1:

The tube is made of a material having a chemical composition consisting of 0.4% of Cu, and the balance Al and inevitable impurities in which, particularly, the amount of Fe and Si is 0.4%. The extrusion characteristics (extrusion rate at a billet temperature of 450° C.) of the above-mentioned aluminum alloy into the heat exchanger tube shown in FIG. 4 was 80 m/min. This extrusion rate is substantially equivalent to that of AA1050 alloy advantageously. On the other hand the AA3003 alloy material exhibits, under the same extrusion condition, a very decreased extrusion rate of 30 m/min.

Figure 4:
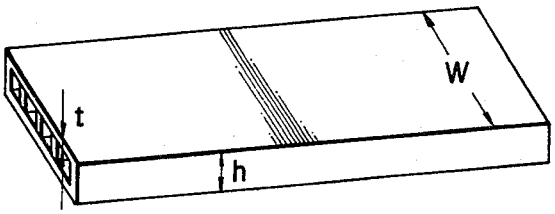
FIG. 4 is a perspective view of an extruded tube as used in the heat exchanger of the invention.

As shown in FIG. 4, the tube has a rectangular cross-section with four parallel bores and a thickness of 1.0 mm. The corrugate fin for use in combination with the tubes is made of a brazing sheet having a total thickness of 0.16 mm and constituted by a core member and claddings to both surfaces of the core member at a cladding ratio of 12% with respect to each side. The material of the core member consists essentially of 0.10% of Cu, 1.1% of Mn, 0.4% of Zn, 0.06% of Sn and the balance Al, while the material of the cladding is a brazing material for vacuum brazing consisting essentially of 10% of Si, 1.5% of Mg and the balance Al.

The fin was secured to the tube by the brazing which is conducted under the vacuum of $4\times10^{-5}$ Torr and at a temperature of 610° C. for 10 minutes to form the heat exchanger as shown in FIG. 1. The tube and fins after the vacuum brazing showed electrochemical potentials of −0.79 V and −0.90 V, respectively, when measured in a 3% aqueous solution of salt (R.T.). For information, the AA1050 alloy material and AA3003 alloy material generally exhibit potentials of −0.86 V and −0.78 V, respectively. Thus, the aluminum alloy used as the tube material of the invention shows a potential close to that of the AA3003 alloy.

The corrosion resistance of the aluminum heat exchanger thus produced was evaluated by a CASS test. The test result showed that the maximum depth of the pitting in the tube is as small as 0.12 mm during the term of 700 hours after the start of the test. The same test was conducted with heat exchangers having tubes made from the AA1050 alloy and AA3003 alloy, by way of reference. The depths of the pitting in the tube were 0.70 mm and 0.12 mm, respectively. It was thus confirmed that the aluminum alloy as tube material of the invention exhibits a corrosion resistance superior to that of the AA1050 alloy and equivalent to that of the AA3003 alloy.

Heat exchangers of second to fifth embodiments were produced by extruding tubes in the same manner as the first embodiment and assembling the tubes in the same manner as in the first embodiment. The fabricating conditions and test results of these embodiments are as follows:

Embodiment 2:

| | |
|---|---|
| components of tube material | Al—0.3% Cu—0.5% (Fe + Si) |
| tube thickness | 0.9 mm |
| components of fin material | |
| core member; Al—0.12% Cu—1.1% Mn—0.4% Zn—0.06% Sn | |
| cladding; Al—10% Si—1.5% Mg | |
| fin thickness | 0.18 mm |
| extrusion characteristic | |
| alloy used in the invention (extrusion rate) | 80 m/min. |
| AA1050 alloy | 80 m/min. |
| AA3003 alloy | 30 m/min. |
| CASS test maximum depth of pitting in tube after 700 hrs. test | |
| alloy used in the invention | 0.15 mm |
| AA1050 alloy | 0.72 mm |

-continued

| | |
|---|---|
| AA3003 alloy | 0.16 mm |
| brazing condition | $6 \times 10^{-5}$ Torr<br>600° C., 8 minutes |

Embodiment 3:

| | |
|---|---|
| components of tube material | Al—0.5% Cu—0.45% (Fe + Si) |
| tube thickness | 0.87 mm |
| components of fin material | |
| core member; Al—0.15% Cu—1.1% Mn—0.4% Zn—0.01 Sn | |
| cladding; Al—9.5% Si—1.3% Mg | |
| fin thickness | 0.16 mm |
| extrusion characteristic | |
| alloy used in invention | 80 m/min. |
| AA1050 alloy | 80 m/min. |
| AA3003 alloy | 30 m/min. |
| CASS test maximum depth of pitting in tube after 1000 hrs. test | |
| alloy used in invention | 0.14 mm |
| AA1050 alloy | 0.78 mm |
| AA3003 alloy | 0.14 mm |
| brazing condition $5 \times 10^{-5}$ Torr, 600° C., 12 minutes | |

Embodiment 4:

| | |
|---|---|
| components of tube material | Al—0.8% Cu—0.4% (Fe + Si) |
| tube thickness | 1.0 mm |
| components of fin material | |
| core member; Al—0.10% Cu—1.1% Mn—1.0% Zn cladding; Al—7.5% Si | |
| fin thickness | 0.16 mm |
| extrusion characteristic | |
| alloy used in the invention | 75 m/min. |
| AA1050 alloy | 80 m/min. |
| AA3003 alloy | 30 m/min. |
| CASS test maximum depth of pitting in tube after 1000 hrs. test | |
| alloy used in invention | 0.16 mm |
| AA1050 alloy | 0.80 mm |
| AA3003 alloy | 0.15 mm |
| brazing condition flux brazing (without Zn) 610° C., 10 minutes | |

Embodiment 5:

| | |
|---|---|
| components of tube material | Al—0.6% Cu—0.8% (Fe + Si) |
| tube thickness | 1.0 mm |
| components of fin material | |
| core member; Al—0.12% Cu—1.1% Mn—0.9% Zn cladding; | |

-continued

| | |
|---|---|
| Al—10% Si—0.08% Bi | |
| fin thickness | 0.16 mm |
| extrusion characteristic | |
| alloy used in invention | 78 m/min. |
| AA1050 alloy | 80 m/min. |
| AA3003 alloy | 30 m/min. |
| CASS test maximum depth of pitting in tube after 1000 hrs test | |
| alloy used in invention | 0.15 mm |
| AA1050 alloy | 0.79 mm |
| AA3003 alloy | 0.15 mm |
| brazing condition 600 Torr in $N_2$ gas atmosphere<br>600° C., 10 minutes | |

Embodiment 6:

Aluminum alloys of compositions of Nos. 1 to 5 in the following table were produced by water-cooled casting to have a billet form of 175 mm diameter×400 mm length. The billets of these alloys were then subjected to a soaking treatment at 250° C. for 3 hours and then to a hot-extrusion at about 450° C. into tubes having a form as shown in FIG. 4, having a wall thickness (t) of 1 mm, width (w) of 32 mm and a height (h) of 5 mm. On the other hand, the fin was formed from a brazing sheet (thickness 0.16 mm) having of a core member of an aluminum alloy consisting of 0.12% Cu 1.1% of Mn, 1.0% of Zn and the balance Al, and claddings to both sides of the core member which claddings is made of an aluminum alloy consisting of 7.5% of Si and the balance Al (AA4343). The brazing sheet was then corrugated to have fins of a height of 20 mm and a pitch of 4 mm.

Figure 5:
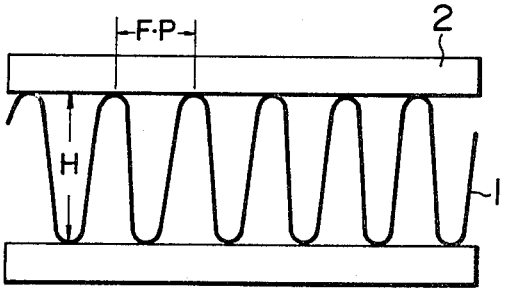
FIG. 5 is a front elevational view of a model core similar to that of the heat exchanger in accordance with the invention.

After degreasing of the tube and the fin, these two members are fixed by an iron jig and were applied with a flux, and were placed in an air furnace at a temperature of 610° C. for 10 minutes for effecting brazing to fabricate a model core as shown in FIG. 5. A CASS test was conducted with these samples, and the period of time was measured until the wall thickness of 1 mm is completely penetrated by the pitting to evaluate the corrosion resistance. Also, the electrochemical potentials of the tubes and fins were measured in 5% aqueous solution of NaCl. Furthermore, the extrusion characteristics were evaluated through measurement of the extrusion rate for the aluminum alloy tube material of the invention. The results of these tests are also shown in the following table, together with the results of the same tests conducted with reference materials Nos. 6 and 7, as well as the conventional alloy.

| | | Cu (%) | Mn (%) | Fe + Si (%) | Balance | Potential mV (SCE) | CASS test (time till penetration) (Hr) | Extrusion characteristics (m/min) |
|---|---|---|---|---|---|---|---|---|
| Alloys of the invention | No. 1 | 0.2 | — | 0.5 | Al and other impurities | −730 | 1400 or longer | 80 |
| | No. 2 | 0.5 | — | 0.5 | Al and other impurities | −720 | 1500 or longer | 80 |
| | No. 3 | 1.0 | — | 0.5 | Al and other impurities | −720 | 1500 or longer | 55 |
| | No. 4 | 0.5 | — | 0.2 | Al and other impurities | −720 | 1500 or longer | 80 |
| | No. 5 | 0.5 | — | 1.0 | Al and other impurities | −720 | 1500 or longer | 55 |
| Reference alloys | No. 6 | 0.1 | — | 0.5 | Al and other impurities | −750 | 300 or longer | 80 |
| | No. 7 | 1.5 | — | 0.5 | Al and other impurities | −720 | 1500 or longer | 40 |
| Conventional alloys | A1050 | — | — | 0.4 | Al and other impurities | −780 | 300 or longer | 80 |
| | A3003 | 0.15 | 1.2 | 0.8 | Al and other impurities | −710 | 1500 or longer | 30 |

-continued

| | Cu (%) | Mn (%) | Fe + Si (%) | Balance | Potential mV (SCE) | CASS test (time till penetration) (Hr) | Extrusion characteristics (m/min) |
|---|---|---|---|---|---|---|---|
| Electro-chemical potential of corrugate sacrificial fin | | | | | −830 mV | | |

Embodiment 7:

An aluminum alloy consisting of 0.4% of Cu, 0.4% of Fe+Si and the balance aluminum was produced by watercooled casting into the form of billets (175 mm diameter×400 mm length) used as the material of the heat exchanger tube. After a soaking at 540° C. for 2 hours, the billets were subjected to a hot-extrusion at 470° C. into the form of tubes as shown in FIG. 4, having a thickness (t) of 1 mm, width (w) of 26 mm and a height (h) of 5 mm. On the other hand, the fin material was constituted by a brazing sheet (0.16 mm thick) having a core member of an aluminum alloy consisting of 0.15% of Cu, 1.1% of Mn, 0.06% of Sn, 0.6% of Zn and the balance Al, and cladding layers at both sides of the core member which cladding layers are made of an aluminum alloy containing 10% of Si, 1.5% of Mg and the balance Al. The brazing sheet was corrugated to have fins of 16 mm height and a pitch of 6 mm.

After degreasing, the tube and fin were fixed by means of an iron jig and were subjected to a vacuum brazing conducted under the vacuum of $5\times10^{-5}$ Torr at 600° C. for 3 minutes to form a model core as shown in FIG. 5. The model core was then subjected to a CASS test. The test result showed that it takes more than 1500 hours until the tube is completely perforated by corrosion. The alloy of the invention showed an extrusion rate of 80 m/min. which is equivalent to that of AA1050 alloy, as well as an electrochemical potential of −720 mV after the vacuum brazing substantially equivalent to that of A3003 alloy, while the fin serving as the sacrificial anode showed a potential of −1100 mV. By way of reference, the same CASS test was conducted with a tube made from AA1050 alloy. In this case, the tube was completely perforated by corrosion after about 500 hours.

Embodiment 8:

A tube was formed by extrusion in the same manner as the Embodiment 7, from an aluminum alloy consisting of 0.5% of Cu, 0.45% of Fe+Si and the balance Al. On the other hand, the fin was formed from a brazing sheet (0.16 mm thickness) constituted by a core member of an aluminum alloy consisting of 0.12% of Cu, 1.1% of Mn, 0.9% of Zn and the balance Al, and cladding layers clad to both side of the core member which layers are made of an aluminum alloy consisting of 10% of Si, 0.06% of Bi, 0.05% of Sn, 0.005% of Be and the balance Al. The brazing sheet was corrugated to have a plurality of fins of 18 mm height and a pitch of 4 mm.

The tube and fin were then subjected to an etching conducted for 1 minutes in a 5% NaOH solution at 60° C., and then to a pickling and rinsing by water. After a sufficient drying, these members were fixed by means of an iron jig, and were subjected to brazing conducted for 4 minutes in an $N_2$ gas atmosphere of 600 Torr to form a model core as shown in FIG. 5. This model core was subjected to a CASS test the result of which showed that it takes more than 1600 hours until the tube is completely perforated by corrosion. The extrusion rate of this alloy was 80 m/min which is equivalent to that of AA1050 alloy while the electrochemical potential after the brazing was −720 mV, while the fin serving as sacrificial anode showed a potential of −1050 mV.

By way of reference, the same CASS test was conducted with a tube made of AA1050 alloy. In this case, the tube was completely perforated by corrosion in about 450 hours.

In the embodiments of the invention described heretofore, aluminum alloys obtained by adding small amounts of Sn, Zn or the like to the AA3003 alloy are used as the material of the core member of the fin. This, however, is not exclusive and any aluminum alloy which exhibits an electrochemical potential value lower than that of the tube material can be used as the material of the fin.

The heat exchanger of the invention exhibits an pitting corrosion resistance of tubes equivalent to that of the conventional heat exchangers incorporating tubes made from AA3003 alloy, as well as a good drawing of extrusion characteristics of the material substantially equivalent to that of AA1050 aluminum to economically lower the cost of production of the heat exchanger as a whole.

What is claimed is:

1. A heat exchanger, comprising:

a plurality of sacrificial anode fins formed of a brazing sheet made of aluminum alloys; and at least one tube made of an aluminum alloy, said fins being secured to said tube by brazing, and said tube aluminum alloy consisting essentially of copper of 0.2–1.0 weight percent and the balance essentially aluminum.

2. A heat exchanger as claimed in claim 1, wherein in the impurities of said tube aluminum alloy the sum of the amount of both iron and silicon is not more than 1.0 weight percent.

3. A heat exchanger, comprising:

at least one hot-extruded heat exchanger tube having a plurality of parallel bores arranged side by side in a series;

said heat exchanger tube being made of an aluminum alloy consisting essentially of 0.2–1.0 weight percent copper and the balance essentially aluminum with inevitable impurities, the sum of the amount of iron and silicon included in such impurities constituting not more than 1.0 weight percent of said aluminum alloy;

said aluminum alloy having a hot extrudability at 450° C. substantially equivalent to that of AA1050 aluminum alloy and an electrochemical potential of about −0.79 V; and a plurality of aluminum alloy fins constituted by brazing sheet means brazed to said heat exchanger tube, said fins due to their constituency exhibiting an electrochemical potential substantially lower than that of said heat exchanger tube, whereby said fins serve as a sacrificial anode means for said heat exchanger tube for improving pitting corrosion resistance of said heat exchanger tube.

4. A heat exchanger as claimed in claim 1 or 2, wherein each of the sacrificial anode fins comprises a core member made of an aluminum alloy consisting essentially by weight of copper of 0.05–0.20%, silicon of not more than 0.6%, iron of not more than 0.7%, manganese of 1.0–1.5%, zinc of not more than 9.0%, tin of not more than 0.06%, and the balance aluminum and inevitable impurities, and cladding layers of another aluminum alloy consisting essentially by weight of silicon of 9.5–10%, magnesium of 1.3–1.5% and the balance aluminum and inevitable impurities.

* * * * *